US012735859B2

(12) United States Patent
Gupta et al.

(10) Patent No.: US 12,735,859 B2
(45) Date of Patent: Sep. 15, 2026

(54) METHODS AND SYSTEMS FOR CONTROLLING EARTH-MOVING VEHICLE OPERATED BY ARTIFICIAL INTELLIGENCE

(71) Applicant: AIM Intelligent Machines, Inc., Monroe, WA (US)

(72) Inventors: Atharva Gupta, Monroe, CA (US); Devin Lu, Seattle, WA (US)

(73) Assignee: AIM Intelligent Machines, Inc., Redmond, WA (US)

( * ) Notice: Subject to any disclaimer, the term of this patent is extended or adjusted under 35 U.S.C. 154(b) by 224 days.

(21) Appl. No.: 18/464,069

(22) Filed: Sep. 8, 2023

(65) Prior Publication Data

US 2025/0084613 A1 Mar. 13, 2025

(51) Int. Cl.
*E02F 3/84* (2006.01)
*E02F 3/76* (2006.01)

(52) U.S. Cl.
CPC ..... *E02F 3/844* (2013.01); *E02F 3/7604* (2013.01)

(58) Field of Classification Search
CPC ..... E02F 3/844; E02F 3/7604; E02F 3/845
See application file for complete search history.

(56) References Cited

U.S. PATENT DOCUMENTS 4,888,890 A 12/1989 Studebaker et al.
5,682,311 A 10/1997 Clark
9,487,929 B2 * 11/2016 Wei ..... E02F 3/841
9,904,747 B2 * 2/2018 Shuler ..... G06F 30/20
10,066,367 B1 * 9/2018 Wang ..... E02F 9/262
10,255,384 B2 * 4/2019 Shuler ..... G06F 30/13
11,346,080 B1 * 5/2022 Kikani ..... E02F 9/2029
12,123,171 B2 * 10/2024 Gajić ..... G06V 20/64
12,325,974 B2 * 6/2025 Ready-Campbell ..... G05D 1/0016
12,503,836 B2 12/2025 Lu et al.
2002/0162668 A1 11/2002 Carlson et al.
2009/0056961 A1 3/2009 Gharsalli et al.
(Continued)

FOREIGN PATENT DOCUMENTS

CN 106522074 A * 3/2017 ..... E01C 3/04
WO WO-2022271512 A1 12/2022
(Continued)

OTHER PUBLICATIONS

Ruiz, "Use of Rotation Matrices to Plot a Circle of Equal Altitude." Journal of maritime research 8 (2011): 51-58. (Year: 2011).*
(Continued)

*Primary Examiner* — Redhwan K Mawari
*Assistant Examiner* — Kai Wang
(74) *Attorney, Agent, or Firm* — Wilson Sonsini Goodrich & Rosati

(57) ABSTRACT

Systems and methods of controlling an earth-moving vehicle (EMV) are disclosed. In one aspect, the system includes an EMV having a boom joint, a boom connected at the boom joint, a blade connected to an end of the boom, and a controller communicably coupled to the EMV, the boom and the blade. The controller is configured to move the EMV along a path, compute a target depth for the blade, position the blade to have the target depth, and dynamically adjust the blade to maintain the target depth as the EMV moves along the path.

29 Claims, 7 Drawing Sheets

(56) References Cited

U.S. PATENT DOCUMENTS

| | | | | |
|---|---|---|---|---|
| 2009/0178816 | A1 | 7/2009 | Piekutowski et al. | |
| 2010/0299031 | A1 | 11/2010 | Zhdanov et al. | |
| 2014/0032030 | A1 | 1/2014 | Stratton et al. | |
| 2014/0229079 | A1 | 8/2014 | Stratton et al. | |
| 2015/0375232 | A1* | 12/2015 | Loijas | B02C 7/06 241/261.3 |
| 2016/0312446 | A1* | 10/2016 | Pettersson | E02F 3/76 |
| 2016/0321763 | A1* | 11/2016 | Shike | G06Q 50/08 |
| 2018/0258610 | A1 | 9/2018 | Elkins | |
| 2020/0299924 | A1 | 9/2020 | Kurokawa et al. | |
| 2021/0095438 | A1* | 4/2021 | Cámara Puerto | E02F 3/088 |
| 2022/0195693 | A1* | 6/2022 | Kalantar | E02F 3/841 |
| 2022/0267999 | A1 | 8/2022 | Hartvig Andersen | |
| 2023/0194280 | A1 | 6/2023 | Braunstein | |
| 2024/0093464 | A1* | 3/2024 | Sadilek | E02F 9/205 |
| 2024/0117598 | A1 | 4/2024 | Kotlaba et al. | |
| 2025/0052039 | A1 | 2/2025 | Lu et al. | |
| 2026/0071410 | A1 | 3/2026 | Lu | |

FOREIGN PATENT DOCUMENTS

| | | | |
|---|---|---|---|
| WO | WO-2025034718 | A1 | 2/2025 |
| WO | WO-2025054304 | A1 | 3/2025 |

OTHER PUBLICATIONS

PCT/US2024/041056 International Preliminary Report on Patentability dated Feb. 19, 2026.
U.S. Appl. No. 18/470,275 Corrected Notice of Allowability dated Nov. 13, 2025.
U.S. Appl. No. 18/470,275 Corrected Notice of Allowability dated Nov. 6, 2025.
PCT/US2024/041056 International Search Report and Written Opinion dated Dec. 30, 2024.
PCT/US2024/041056 Invitation to Pay Additional Fees dated Nov. 16, 2024.
PCT/US2024/045356 International Search Report and Written Opinion dated Nov. 22, 2024.
Mononen, Teemu et al. Blade Control for Surface Profile Tracking by Heavy-Duty Bulldozers. Proceedings of the ASME/BATH 2021 Symposium on Fluid Power and Motion Control (FPMC2021) :1-8 (2021).
Qi, Peng, and Liang, Gong. 3D Guidance Navigation and Human-Robot Shared Control for Motor Graders in Field Operation. The 8th International Conference on Mechatronics and Robotics Engineering (ICMRE), IEEE :79-83 (2022).
U.S. Appl. No. 18/470,275 Corrected Notice of Allowability dated Sep. 4, 2025.
U.S. Appl. No. 18/470,275 Notice of Allowance dated Aug. 26, 2025.
U.S. Appl. No. 18/470,275 Office Action dated Jul. 15, 2025.

* cited by examiner

METHODS AND SYSTEMS FOR CONTROLLING EARTH-MOVING VEHICLE OPERATED BY ARTIFICIAL INTELLIGENCE

BACKGROUND

Earth-moving vehicles (EMVs) are heavy equipment machines designed to move large quantities of earth, rocks, soil, or debris during construction, mining, agriculture, or any other earth-moving activity. These vehicles are designed to perform a variety of tasks, such as excavation, grading, leveling, hauling, and demolition. A bulldozer can be used to move and grade dirt across large tracts of land. Grading in construction includes the work of ensuring a level base, or one with a specified slope, for a construction work such as a foundation, the base course for a road or a railway, or landscape and garden improvements, or surface drainage.

SUMMARY

The present disclosure provides systems and methods directed to dynamically controlling an EMV and components, such as a blade, of the EMV. The systems and methods herein can help grade the ground at a desired depth relative to sea level. The systems and methods described herein can help automatically maintain a desired depth of the blade when the EMV is in operation. The systems and methods herein can help dynamically adjust the depth of the blade when the EMV is on a slope. The systems and methods herein can help create a level base at a construction site efficiently.

An aspect includes a method of operating an EMV including a boom connected to the EMV at a boom joint and a blade connected to an end of the boom, comprising: moving the EMV along a path; computing a target depth for the blade; positioning the blade to have the target depth; and dynamically adjusting the blade to maintain the target depth as the EMV moves along the path.

In some embodiments, the method further comprises determining, based on one or more sensors, a blade boom angle and a machine pitch, wherein the blade boom angle includes an angle formed by the boom relative to a line parallel to a bottom plane of the EMV, and wherein the machine pitch is an angle measured relative to the direction of gravity.

In some embodiments, the one or more sensors includes an inclinometer mounted on the blade.

In some embodiments, the one or more sensors includes an inclinometer mounted on a bottom of the EMV.

In some embodiments, the method further comprises computing a net pitch angle based on the determined blade boom angle and determined machine pitch.

In some embodiments, computing the net pitch angle includes adding the determined blade boom angle and the determined machine pitch.

In some embodiments, the method further comprises computing a current vector extending from the boom joint to a bottom corner of the blade.

In some embodiments, computing the current vector comprises computing a rotation matrix.

In some embodiments, the rotation matrix includes the following matrix:

$$\begin{bmatrix} \cos\theta & 0 & \sin\theta \\ 0 & 1 & 0 \\ -\sin\theta & 0 & \cos\theta \end{bmatrix},$$

where θ includes a net pitch angle.

In some embodiments, computing the current vector further comprises performing a matrix multiplication of a base vector with the rotation matrix, and wherein the base vector extends from the boom joint to the bottom corner of the blade when the blade boom angle and the machine pitch are 0 degrees.

In some embodiments, the method further comprises computing a current depth of the bottom corner of the blade.

In some embodiments, computing the current depth of the bottom corner of the blade comprises adding the current vector and a boom joint vector, wherein the boom joint vector includes a difference between an EMV center and the position of the boom joint.

In some embodiments, the method further comprises comparing the current depth to the target depth.

In some embodiments, the dynamically adjusting the blade comprises (1) increasing the blade boom angle when the current depth is greater than the target depth and (2) decreasing the blade boom angle when the current depth is less than the target depth.

In some embodiments, dynamically adjusting the blade comprises (1) lowering the blade when a current depth is less than the target depth and (2) raising the blade when the current depth is less than the target depth.

In some embodiments, the current depth is a depth of the lowest point of the blade.

In some embodiments, the method further comprises computing the current depth as a sum of a current vector and a boom joint vector, wherein the current vector extends from the boom joint to a position of the lowest point of the blade, and wherein the boom joint vector extends from the machine center of the EMV to the boom joint.

In some embodiments, the method further comprises computing the current vector by performing matrix multiplication of a base vector and a rotation matrix.

In some embodiments, the base vector extends from the boom joint to a bottom corner of the blade when a blade boom angle and a machine pitch are 0 degrees.

In some embodiments, the blade boom angle includes an angle formed by the boom relative to a line parallel to a bottom plane of the EMV, and wherein the machine pitch is an angle formed between the bottom plane of the EMV relative to the direction of gravity.

In some embodiments, the method further comprises computing the rotation matrix based on a net pitch angle, wherein the net pitch angle is a sum of the blade boom angle and the machine pitch.

In some embodiments, the machine center includes a latitude, longitude, and altitude of the EMV.

In some embodiments, the method further comprises computing the machine center based on real-time GPS positioning.

In some embodiments, the EMV includes a bulldozer.

In some embodiments, the method further comprises: computing a second target depth for a ripper connected to the EMV; positioning the ripper to have the second target depth; and dynamically adjusting the ripper to maintain the second target depth as the EMV moves along the path.

In some embodiments, the positioning of the ripper and the dynamically adjusting the ripper is performed while the EMV is moving downhill or on approximately level ground or surface.

In some embodiments, the positioning the ripper includes penetrating the ground with one or more teeth of the ripper.

In some embodiments, the method further comprises, after penetrating the ground, rolling the one or more teeth forward to give traction.

In some embodiments, the EMV includes a toolbar connected to the ripper, and wherein a position of the toolbar is above ground while the ripper is penetrated.

In some embodiments, moving the EMV includes moving the EMV in a straight path while the ripper is in operation.

In some embodiments, the method further comprises: detecting, by one or more sensors of the EMV, one or more materials having one or more qualities; and maintaining the position of the ripper to be above ground based at least in part on the one or more materials having the one or more qualities.

Another aspect is a system, comprising: an earth-moving vehicle (EMV) having a boom joint; a boom connected at the boom joint; a blade connected to an end of the boom; and a controller communicably coupled to the EMV, the boom and the blade, wherein the controller is configured to: move the EMV along a path; compute a target depth for the blade; position the blade to have the target depth; and dynamically adjust the blade to maintain the target depth as the EMV moves along the path.

In some embodiments, the system further comprises one or more sensors configured to detect a blade boom angle and a machine pitch, wherein the blade boom angle includes an angle formed by the boom relative to a line parallel to a bottom plane of the EMV, and wherein the machine pitch is an angle measured relative to the direction of gravity.

In some embodiments, the one or more sensors includes an inclinometer mounted on the blade.

In some embodiments, the one or more sensors includes an inclinometer mounted on a bottom of the EMV.

In some embodiments, the controller is further configured to compute a net pitch angle based on the determined blade boom angle and determined machine pitch.

In some embodiments, the controller is further configured to add the determined blade boom angle and the determined machine pitch.

In some embodiments, the controller is further configured to compute a current vector extending from the boom joint to a bottom corner of the blade.

In some embodiments, the controller is further configured to compute the current vector comprises computing a rotation matrix.

In some embodiments, the rotation matrix includes the following matrix:

$$\begin{bmatrix} \cos\theta & 0 & \sin\theta \\ 0 & 1 & 0 \\ -\sin\theta & 0 & \cos\theta \end{bmatrix},$$

where θ includes a net pitch angle.

In some embodiments, the controller is further configured to perform a matrix multiplication of a base vector with the rotation matrix, and wherein the base vector extends from the boom joint to the bottom corner of the blade when the blade boom angle and the machine pitch are 0 degrees.

In some embodiments, the controller is further configured to compute a current depth of the bottom corner of the blade.

In some embodiments, the controller is further configured to add the current vector and a boom joint vector, and wherein the boom joint vector includes a difference between an EMV center and the position of the boom joint.

In some embodiments, the controller is further configured to compare the current depth to the target depth.

In some embodiments, the controller is further configured to (1) increase the blade boom angle when the current depth is greater than the target depth and (2) decrease the blade boom angle when the current depth is less than the target depth.

In some embodiments, the controller is further configured to (1) lower the blade when a current depth is less than the target depth and (2) raise the blade when the current depth is less than the target depth.

In some embodiments, the current depth is a depth of the lowest point of the blade.

In some embodiments, the controller is further configured to compute the current depth as a sum of a current vector and a boom joint vector, wherein the current vector extends from the boom joint to a position of the lowest point of the blade, and wherein the boom joint vector extends from the machine center of the EMV to the boom joint.

In some embodiments, the controller is further configured to compute the current vector by performing matrix multiplication of a base vector and a rotation matrix.

In some embodiments, the base vector extends from the boom joint to a bottom corner of the blade when a blade boom angle and a machine pitch are 0 degrees.

In some embodiments, the blade boom angle includes an angle formed by the boom relative to a line parallel to a bottom plane of the EMV, and wherein the machine pitch is an angle formed between the bottom plane of the EMV relative to the direction of gravity.

In some embodiments, the controller is further configured to compute the rotation matrix based on a net pitch angle, wherein the net pitch angle is a sum of the blade boom angle and the machine pitch.

In some embodiments, the machine center includes a latitude, longitude, and altitude of the EMV.

In some embodiments, the controller is further configured to compute the machine center based on real-time GPS positioning.

In some embodiments, the EMV includes a bulldozer.

In some embodiments, the system further comprises a ripper connected to the EMV, wherein the controller is further configured to: compute a second target depth for the ripper; position the ripper to have the second target depth; and dynamically adjust the ripper to maintain the second target depth as the EMV moves along the path.

In some embodiments, the controller is configured to position of ripper and dynamically adjust the ripper while the EMV is moving downhill or on approximately level ground or surface.

In some embodiments, the controller is configured to penetrate the ground with one or more teeth of the ripper.

In some embodiments, the controller is configured to, after penetrating the ground, roll the one or more teeth forward to give traction.

In some embodiments, the system further comprises a toolbar connected to the ripper and the EMV, and wherein a position of the toolbar is above ground while the ripper is penetrated.

In some embodiments, EMV is configured to move in a straight path while the ripper is in operation.

In some embodiments, the EMV comprises one or more sensors configured to detect one or more materials having one or more qualities, and wherein the controller is further configured to maintain the position of the ripper to be above ground based at least in part on the one or more materials having the one or more qualities.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings (also "Figure" and "FIG." herein), of which:

DETAILED DESCRIPTION

Overview

Grading is the process of reshaping land at a construction site. This can include raising or lowering ground levels, adding or removing slopes or leveling the ground surface. In general, grading is performed to create proper drainage and/or preparing land to bear weight, such as buildings, roads, and other structures. Grading varies depending on each project's scale and needs and often involves leveling the land to prepare for building construction or landscaping. Proper grading can confer several benefits. For example, grading can help prevent pooling of water and other liquids that can damage grass or attract mosquitos. It also prevents water from running into buildings, avoiding expensive structural damage. Proper grading can also prevent future construction issues because laying a foundation on unlevel ground, for example, can become costly to repair.

Conventional methods of grading can be challenging for various reasons. First, grading by a human operator often involves estimating the depth at which the grading is occurring, and can raise potential safety issues, especially when grading with heavy machinery like one or more bulldozers. Also, grading requires manipulating the earth which can vary in soil type, slope, drainage, and groundwater levels. These factors can cause grading to be challenging to accurately and consistently control the blade, which can lead to repetition and inefficiencies. Furthermore, autonomously operating components/tools or extensions of the EMV is critical to fully automating the operation of the EMV, which can confer other benefits such as removing dangerous conditions and increasing productivity that can lead to completing projects faster and with greater safety.

The present disclosure includes systems and methods that provide advantages over conventional EMVs by, for example, dynamically controlling components of the EMV when controlling the EMV with artificial intelligence. Controlling an EMV with artificial intelligence can offer advantages over human operation, such as increased safety and productivity, which can lead to fewer accidents and earlier project completions. A component such as a blade can be maintained by the artificial intelligence-controlled controller to have a desired depth during a grading process at a construction site. The depth can be maintained to be at a desired height relative to absolute sea level, such that the end result is a level surface relative to the sea level. Furthermore, the systems and methods described herein can help create level surfaces efficiently and autonomously.

Machine with Blade

Figure 1:
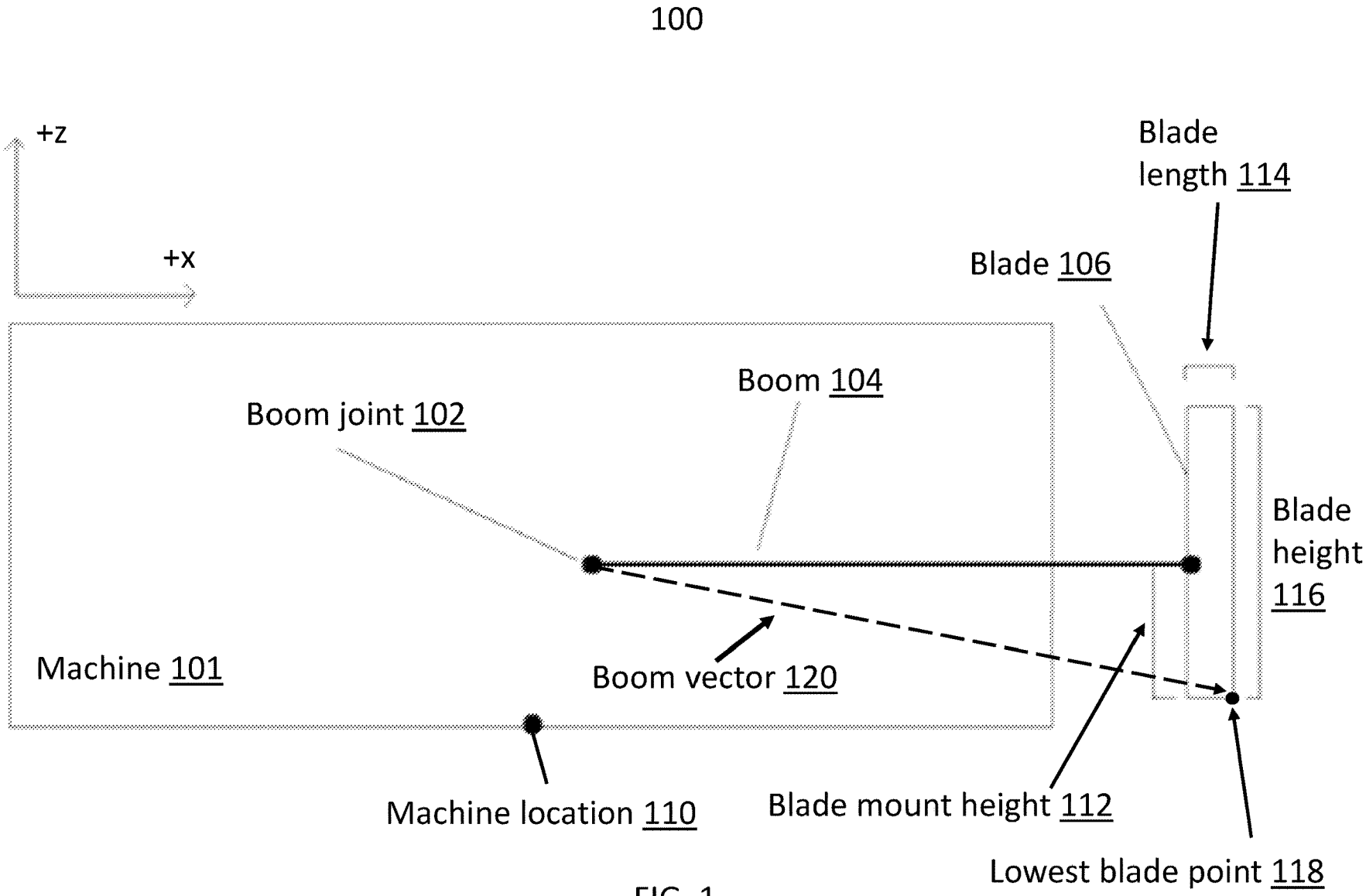
FIG. 1 shows a non-limiting system of a machine that includes a boom and a blade, in accordance with some embodiments.

FIG. 1 illustrates a non-limiting system 100 of a machine (or EMV) 101 that includes a boom (or an arm) 104 and a blade 106, in accordance with some embodiments. The machine 101, boom, and blade 106 can be controlled by one or more processors and/or controllers. The system 100 is shown in a default position where boom is parallel to a bottom plane of the machine 101. The boom 104 can extend toward a front of the machine 101 and rotate around boom joint 102 such that the blade 106 can be positioned in front of the machine 101 during operation, the blade 106 moving along a substantially angular vertical axis facilitated by the movement of a plurality of hydraulic pistons (not shown). The boom 104 is connected to the machine 101 at a boom joint 102. The blade 106 can have a blade length 114 that extends in an +x-direction and a blade height 116 that extends in a +z-direction. The blade length 114 can be the distance from the edge of the face of the blade closest to the machine 100 to the farthest point away from the machine 101. The boom 104 can be connected to the blade 106 at a blade mount. A blade mount height 112 can include a height or length of the blade mount to the bottom of the blade 106.

In some embodiments, the vehicle comprises an EMV or piece of heavy machinery. In some embodiments, the earthmoving vehicle or piece of heavy machinery can include a bulldozer, earthmover, backhoe, shovel, tractor, snowcat, excavator, crane, forklift, boring machine, harvester, compactor, drilling machine, pile driver, street sweeper, snowplow machine, cherry picker, or dump truck.

In FIG. 1, the boom 104 extends in the +x-direction and is parallel or substantially parallel to the machine 101 being on a level surface. The lowest blade point 118 can be the lowest or bottommost point on the blade 106 that touches or is lowered into the ground during operation. The boom vector 120 includes a vector that extends from the boom join 102 to the lowest blade point 118.

The location of the boom joint 102 can be relative to a machine center (e.g., center of the machine 101) and be called boom joint location. For example, if the boom joint location is described as [0.5, 0, 1], the boom joint location is 50 cm to the front, 0 cm to the right, and 1 meter above the machine center. The boom joint location can also be described as boom joint vector [x, y, z] from the machine center to the boom joint location. In some embodiments, the method further comprises computing the machine center based on real-time GPS positioning.

Figure 2:
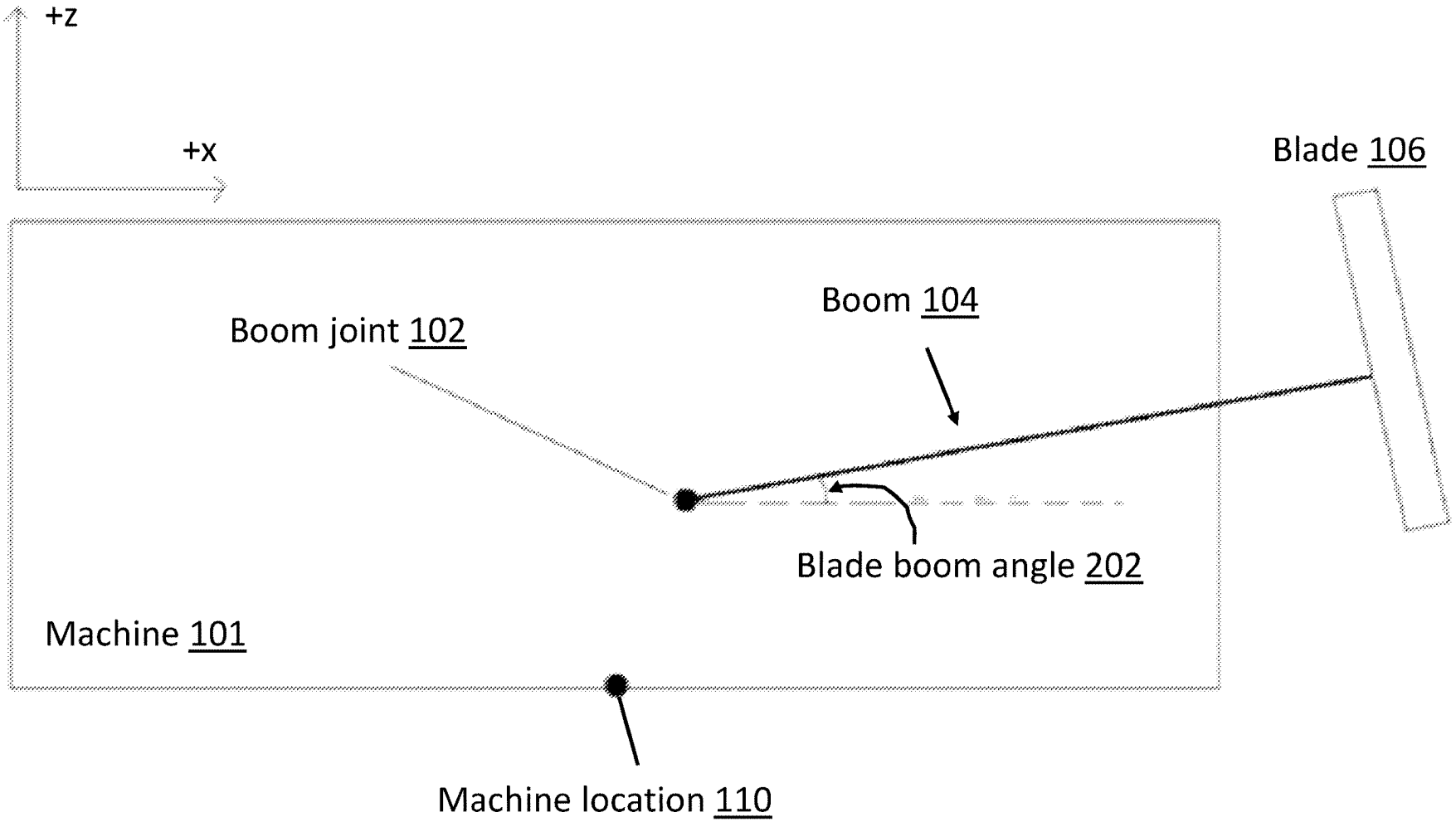
FIG. 2 shows the non-limiting system of FIG. 1 with the machine that has the blade that is raised, in accordance with some embodiments.

FIG. 2 illustrates the non-limiting system 100 with the machine 101 that has the blade 106 that is raised, in accordance with some embodiments. The blade 106 is raised by controlling the boom 104 to rotate such that a blade boom angle 202 is created. The blade boom angle 202 can be the angle created by the x-axis and the boom 104 that is rotated. For reference, in FIG. 1, the blade boom angle 202 is 0 degrees. For example, a positive blade boom angle 202 can indicate that the blade 106 is raised above the default position, and a negative blade boom angle 202 can indicate that the blade is lowered from the default position.

Figure 3:
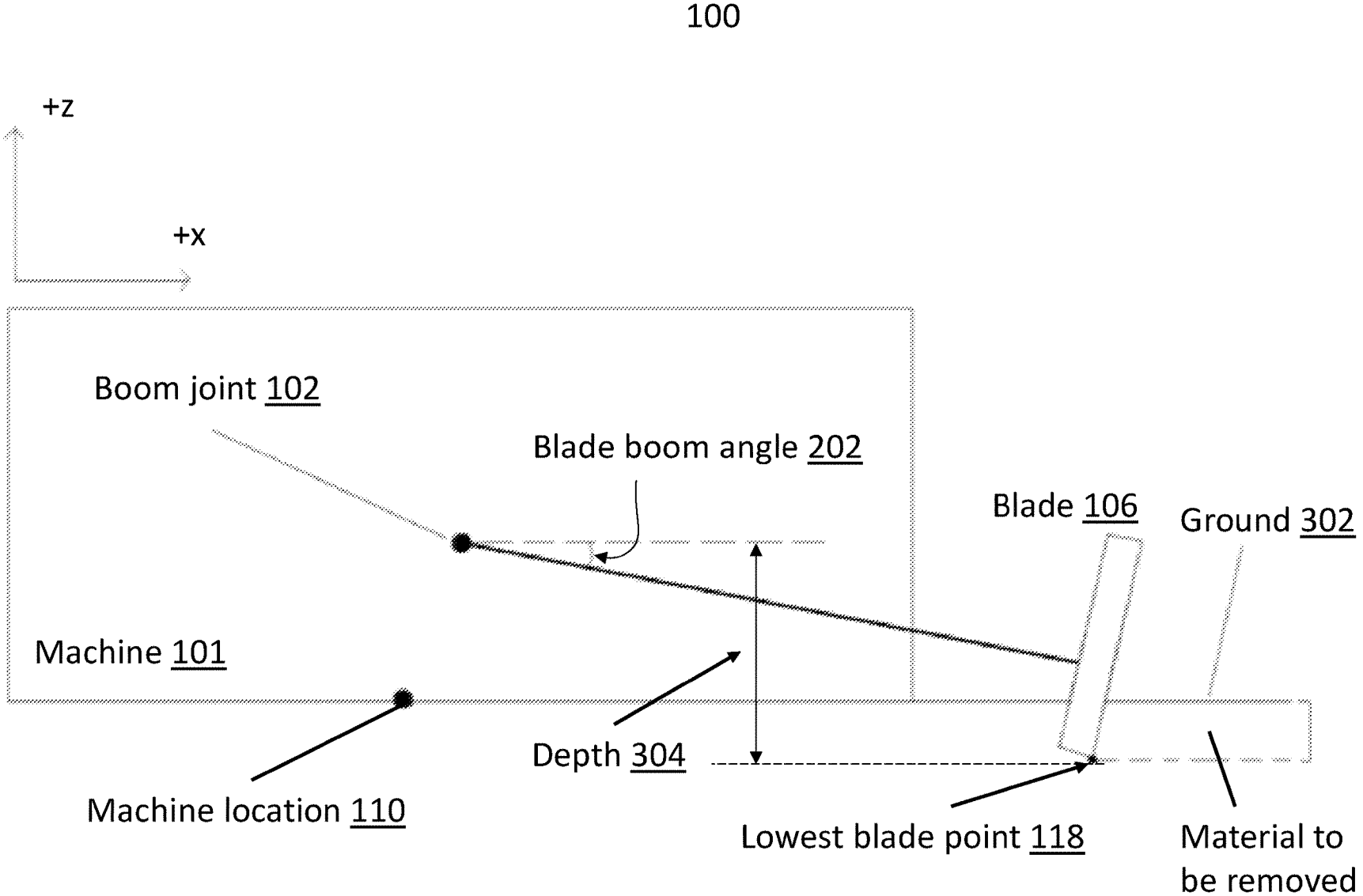
FIG. 3 shows the non-limiting system of FIG. 1 with the machine that has the blade lowered to the ground, in accordance with some embodiments.

FIG. 3 illustrates the non-limiting system 100 with the machine 101 that has the blade 106 lowered to the ground 302, in accordance with some embodiments. The resulting blade boom angle 202 can have the opposite sign compared to the blade boom angle 202 of FIG. 2. For example, the blade boom angle 202 of FIG. 2 can have a positive (+) sign, and the blade boom angle 202 of FIG. 3 can have a negative (−) sign. When the machine 101 is in operation and grading at a construction site, the blade 106 can be lowered to the ground, and the lowest blade point 118 can be the corner or edge of the blade that is lowest to the absolute sea level. By moving the EMV forward while the blade 106 is lowered to a desired depth (e.g., the lowest blade point 118 is at a desired depth), the blade 106 can push material (e.g., soil, rocks, etc.) so that the result is a level ground relative to absolute sea level. Using the methods and systems described herein, a desired depth for the lowest blade point 118 can be computed such that the resulting surface is level, e.g., relative to absolute sea level. Depth 304 is the target depth of the blade in order to doze or grade the material. For example, the depth 304 can indicate the position of the lowest blade point 118.

Figure 4:
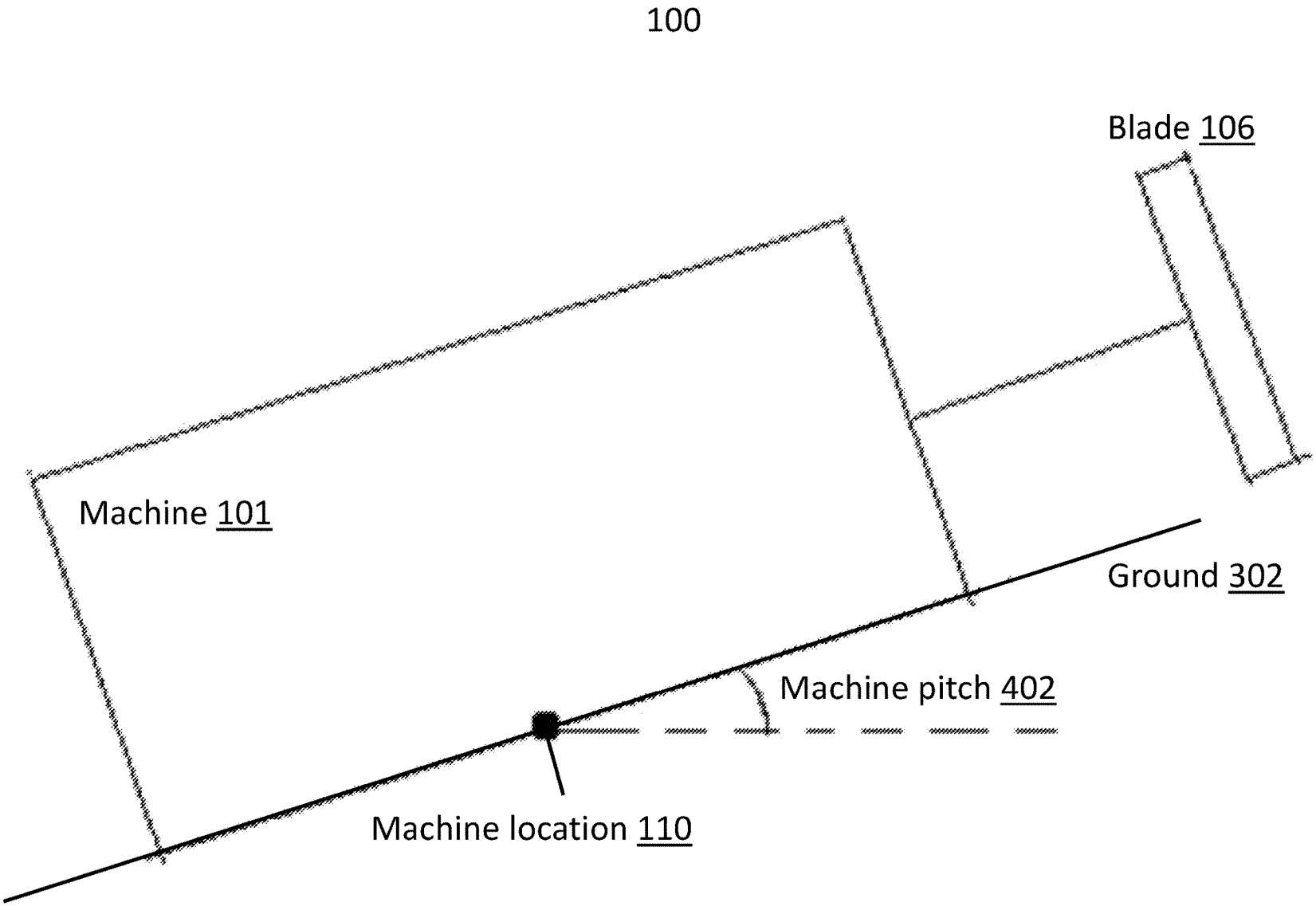
FIG. 4 shows the non-limiting system of FIG. 1 with the machine that is on a slope, in accordance with some embodiments.

FIG. 4 illustrates the non-limiting system 100 with the machine 101 that is on a slope, in accordance with some embodiments. Most of the time the machine 101 is not on level ground while in operation, and the machine 101 is either on a downward slope (e.g., front of machine 101 is lower than a back of the machine 101) or on an upward slope (e.g., front of machine 101 is higher than the back of the machine 101). A machine pitch 402 can include the angle between the ground (or a bottom plane of the machine 101) and a plane that is level relative to absolute sea level. In some embodiments, the machine pitch 402 can be positive or negative, depending on whether the machine 101 is on an upward slope or a downward slope.

Dynamic Blade Control

In some embodiments, grading control relative to sea level for autonomous blade operation includes dynamically controlling the depth of the blade. Generally, the machine center can include latitude, longitude, and/or altitude as computed from a global positioning system (GPS) and connected real-time kinematics (RTK) rovers and other components. In some embodiments, to find the blade location (e.g., lowest blade point) relative to sea level, the absolute machine location can be added to the blade location relative to machine center. Then to grade relative to absolute sea level, the blade level can be kept relative to sea level throughout the grading run. In some embodiments, the blade location can be maintained relative to sea level by computing the blade depth with respect to the machine center and adding the absolute machine center.

In some embodiments, an optimal trajectory or path for a bulldozer can be calculated. For example, given a trench that the user desires to push or dig and the associated heights at each point of the ground, the optimal trajectory or path for the EMV can be calculated by calculating how much material (e.g., how deep the blade goes) to remove at each point. For example, if there is a trench 100 meters long, the blade is 1 meter wide, and a maximum of 10 cubic meters of soil for a given dozer and blade can be pushed, the blade can go 0.1 meters below the ground depth at each point so that it's pushing substantially equivalent of 10 cubic meters of soil at the end of the trench.

Once this optimal trajectory is computed, the desired or target depth of the blade can be calculated so that the depth of the blade is close to that depth at each point throughout the trench. Using the systems and methods described herein, the blade depth in real time can be calculated to know whether the blade should go up (be raised), go down (be lowered), or stay level.

Blade Depth Calculation

In some embodiments, the lowest blade point can be calculated as follows. First, the boom vector is determined when the machine is at 0 degrees of the blade boom angle and machine pitch, which can also be the base vector. In some embodiments, the base vector can be a machine configuration stored in a memory connected to a controller. Next, the blade boom angle can be obtained from inclinometer(s) mounted on the blade and the machine pitch from inclinometer(s) mounted on the machine floor (near or where the bottom plane of the machine 101 is). Then, the base vector can be rotated by a net pitch angle that is an addition of the blade boom angle and the machine pitch which can be called a current vector. Then, the current vector can be added by the boom joint location (e.g., vector from the machine center to a location of the boom joint) to get the location of the lowest blade point relative to the machine location.

In some embodiments, the lowest blade point can be calculated as a series of steps as follows:

First, the base vector is a vector of [blade_boom_len+blade_len, 0, −blade_mount_height], where blade_boom_len is the boom length, blade_len is the blade length 114, and blade_mount_height is the blade mount height 112. The vector can be defined as standard 3-coordinate format of [x, y, z].

Second, the net_pitch can equal blade_boom_angle+machine pitch, where the net_pitch is the net pitch, the blade_boom_angle is the blade boom angle 202, and the machine pitch is the machine pitch 402. Third, rotation matrix $M=R_y(-\text{net_pitch})$, where $R_y(\theta)$ is defined as the pitch rotation matrix $$\begin{bmatrix} \cos\theta & 0 & \sin\theta \\ 0 & 1 & 0 \\ -\sin\theta & 0 & \cos\theta \end{bmatrix}$$

where θ is the net pitch angle.

Fourth, the current vector can be calculated as a matrix multiplication of the base vector by the rotation matrix M.

Fifth, the blade position can be calculated as an addition of current vector plus the boom joint vector. The depth 304, which is the current depth of the blade (or the lowest blade point 118), can be the z-coordinate of the resulting vector.

The depth 304 can be compared against a target depth. If the resulting depth 304 is less than the target depth (e.g., the blade bottom is higher than the target depth), the blade boom angle can be increased, causing the blade bottom to be moved lower. If the resulting depth 304 is greater than the target depth (e.g., the blade bottom is lower than the target depth), the blade boom angle can be decreased, causing the blade bottom to be raised or moved higher.

An aspect includes a method of operating an EMV (e.g., machine 101) including a boom (e.g., boom 104) connected to the EMV at a boom joint (boom join 102) and a blade (e.g., 106) connected to an end of the boom, comprising: moving the EMV along a path; computing a target depth for the blade; positioning the blade to have the target depth; and dynamically adjusting the blade to maintain the target depth as the EMV moves along the path.

In some embodiments, the method further comprises determining, based on one or more sensors, a blade boom angle (e.g., blade boom angle 202) and a machine pitch (e.g., machine pitch 402), wherein the blade boom angle includes an angle formed by the boom relative to a line parallel to a bottom plane of the EMV, and wherein the machine pitch is an angle measured relative to the direction of gravity. In some embodiments, the one or more sensors includes an inclinometer mounted on the blade. In some embodiments, the one or more sensors includes an inclinometer mounted on a bottom of the EMV. The inclinometers can be used to measure an angle of inclination or slope of the EMV or surface with respect a level surface or plane (e.g., a surface that is parallel or substantially level to the sea level). The inclinometers can be digital or analog.

In some embodiments, the method further comprises computing a net pitch angle based on the determined blade boom angle and determined machine pitch. In some embodiments, computing the net pitch angle includes adding the determined blade boom angle and the determined machine pitch. In some embodiments, the blade boom angle may be positive or negative, the machine pitch may be positive or negative, and/or the net pitch angle may be positive or negative. In some embodiments, one or more of these angles may be 0 degrees. In some embodiments, the pitch computation (e.g., machine, the boom, and the blade) can be based on a different coordinate system where increasing pitch for all movements can be considered positive or negative.

In some embodiments, the method further comprises computing a current vector (boom vector 120 at a current configuration of the boom 104, blade boom angle 202, and machine pitch 402) extending from the boom joint to a bottom corner of the blade. In some embodiments, computing the current vector comprises computing a rotation matrix.

In some embodiments, computing the current vector further comprises performing a matrix multiplication of a base vector with the rotation matrix, and wherein the base vector extends from the boom joint to the bottom corner of the blade when the blade boom angle and the machine pitch are 0 degrees.

In some embodiments, the method further comprises computing a current depth of the bottom corner of the blade. In some embodiments, computing the current depth of the bottom corner of the blade comprises adding the current vector and a boom joint vector, wherein the boom joint vector includes a difference between an EMV center and the position of the boom joint.

In some embodiments, the method further comprises comparing the current depth to the target depth. In some embodiments, the current depth is a depth of the lowest point of the blade. In some embodiments, the dynamically adjusting the blade comprises (1) increasing the blade boom angle when the current depth is greater than the target depth and (2) decreasing the blade boom angle when the current depth is less than the target depth. In some embodiments, dynamically adjusting the blade comprises (1) lowering the blade when a current depth is less than the target depth and (2) raising the blade when the current depth is less than the target depth.

In some embodiments, the method further comprises computing the current depth as a sum of a current vector and a boom joint vector, wherein the current vector extends from the boom joint to a position of the lowest point of the blade, and wherein the boom joint vector extends from the machine center of the EMV to the boom joint. In some embodiments, the method further comprises computing the current vector by performing matrix multiplication of a base vector and a rotation matrix. In some embodiments, the base vector extends from the boom joint to a bottom corner of the blade when a blade boom angle and a machine pitch are 0 degrees. In some embodiments, the blade boom angle includes an angle formed by the boom relative to a line parallel to a bottom plane of the EMV, and wherein the machine pitch is an angle formed between the bottom plane of the EMV relative to the direction of gravity.

The above steps can be repeatedly performed to calculate a new depth of the blade as the EMV moves along the trench or path. The steps can be repeated until the end of the desired trench or path is reached.

Accordingly, the depth of the blade can be dynamically adjusted based on a calculation of the current depth of the blade.

Dynamic Ripper Control

A ripper is a type of heavy equipment attachment that can be used to break up and loosen hard materials such as rock, concrete, or asphalt. The ripper can include a single shank or multiple shanks with pointed tips (or teeth). The ripper can be attached to a back of the EMV, such as the bulldozer, an excavator, or other construction machinery. The ripper (or the ripper teeth) can be controlled similarly to the blade. For example, the depth of the ripper or ripper teeth can maintain a desired depth while the EMV is moving in a path so that the ripper can break up the rock formations, concrete slabs, and other hard surfaces. Because over-ripping can waste motion and increase costs to operating the machines, it is advantageous to use the ripper only when necessary or when the user knows when the ripper can be effective.

In some embodiments, the ripper can function when or only when a cutting edge of the blade of the EMV or bulldozer cannot penetrate the ground. In some embodiments, the front rollers can be lifted off the ground when loading the ripper onto the machine. In some embodiments, the EMV can travel or always travel an additional 20 feet (or about 20 feet) after removing ripper teeth from the ground before backing up to expose any objects that may be hidden under the toolbar. The 20 feet or about 20 feet helps the ripper not dig up big rocks that the EMV would back into.

In some embodiments, the method further comprises: computing a second target depth for a ripper connected to the EMV; positioning the ripper to have the second target depth; and dynamically adjusting the ripper to maintain the second target depth as the EMV moves along the path. In some embodiments, the positioning of the ripper and the dynamically adjusting the ripper is performed while the EMV is moving downhill or on approximately level ground or surface.

In some embodiments, the positioning the ripper includes penetrating the ground with one or more teeth of the ripper. In some embodiments, the method further comprises, after penetrating the ground, rolling the one or more teeth forward to give traction.

In some embodiments, the EMV includes a toolbar connected to the ripper, and wherein a position of the toolbar is above ground while the ripper is penetrated.

In some embodiments, moving the EMV includes moving the EMV in a straight path while the ripper is in operation.

In some embodiments, the ripper is used or in operation when the EMV is going downhill or on level ground. Whether or not the EMV is going uphill, downhill, or level ground, can be based on the machine pitch. The ripper can be used going downhill or on level ground because gravity can put much stress on the machine, making it difficult to use the ripper.

In some embodiments, the method further comprises: detecting, by one or more sensors of the EMV, one or more materials having one or more qualities; and maintaining the position of the ripper to be above ground based at least in part on the one or more materials having the one or more qualities. When the ripper is maintained above ground, the material is not ripped. The one or more materials can be for example rare or valuable materials or minerals that are better kept intact, rather than being broken up. In some embodiments, the one or more sensors can include an optical sensor, ultrasonic sensors, spectrometers, temperature sensors, and others. Based on the detected qualities of the material, if the material is considered valuable or meets a threshold, the material can be kept intact and not ripped.

Computing System

Figure 5:
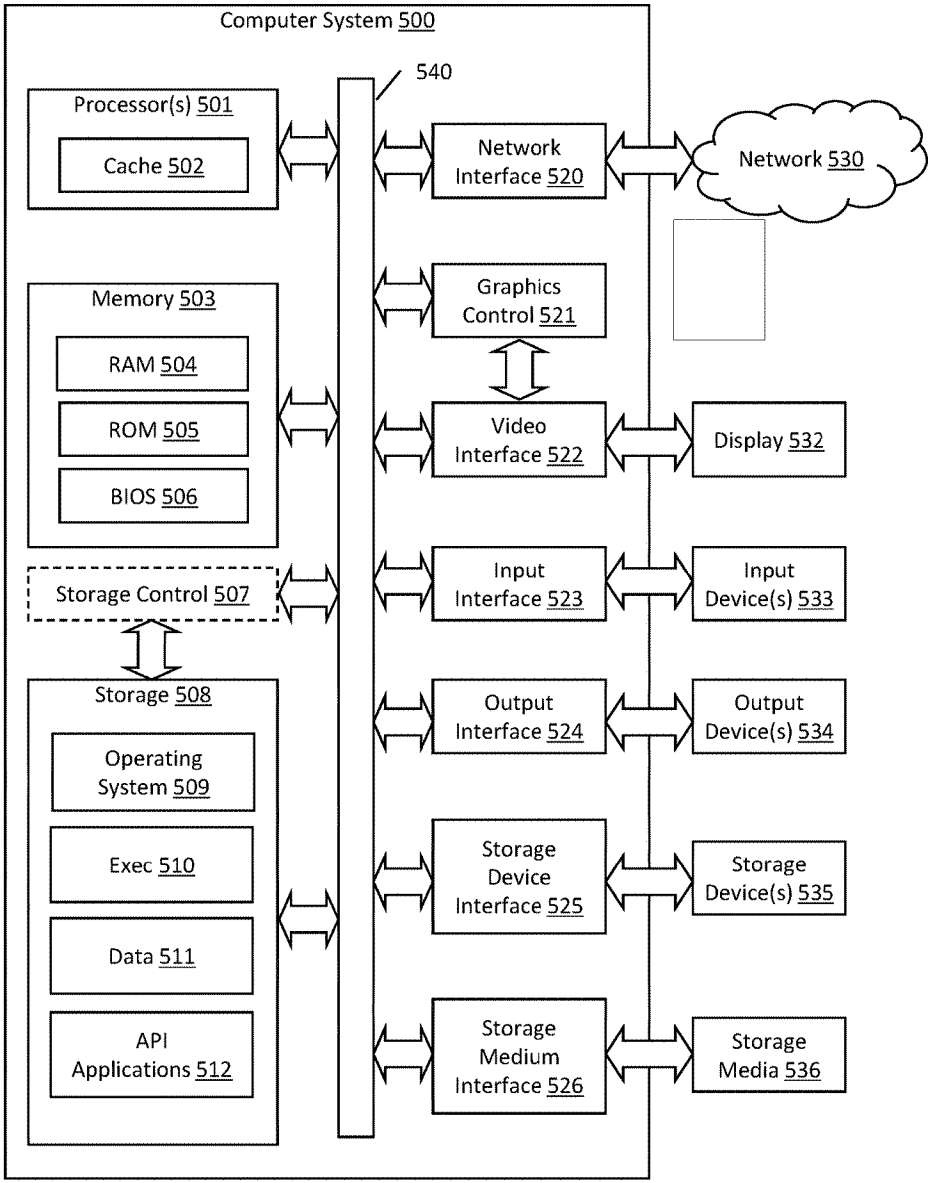
FIG. 5 shows a non-limiting example of a computing device; in this case, a device with one or more processors, memory, storage, and a network interface, in accordance with some embodiments.

Referring to FIG. 5, a block diagram is shown depicting an exemplary machine (e.g., EMV) that includes a computer system 500 (e.g., a processing or computing system) within which a set of instructions can execute for causing a device to perform or execute any one or more of the aspects and/or methodologies for static code scheduling of the present disclosure. The components in FIG. 5 are examples only and do not limit the scope of use or functionality of any hardware, software, embedded logic component, or a combination of two or more such components implementing particular embodiments.

Computer system 500 may include one or more processors 501, a memory 503, and a storage 508 that communicate with each other, and with other components, via a bus 540. The bus 540 may also link a display 532, one or more input devices 533 (which may, for example, include a keypad, a keyboard, a mouse, a stylus, etc.), one or more output devices 534, one or more storage devices 535, and various tangible storage media 536. All of these elements may interface directly or via one or more interfaces or adaptors to the bus 540. For instance, the various tangible storage media 536 can interface with the bus 540 via storage medium interface 526. Computer system 500 may have any suitable physical form, including but not limited to one or more integrated circuits (ICs), printed circuit boards (PCBs), laptop or notebook computers, distributed computer systems, computing grids, or servers.

Computer system 500 includes one or more processor(s) 501 (e.g., central processing units (CPUs), general purpose graphics processing units (GPGPUs), or quantum processing units (QPUs)) that carry out functions. Processor(s) 501 optionally contains a cache memory unit 502 for temporary local storage of instructions, data, or computer addresses. Processor(s) 501 are configured to assist in execution of computer readable instructions. Computer system 500 may provide functionality for the components depicted in FIG. 5 as a result of the processor(s) 501 executing non-transitory, processor-executable instructions embodied in one or more tangible computer-readable storage media, such as memory 503, storage 508, storage devices 535, and/or storage medium 536. The computer-readable media may store software that implements particular embodiments, and processor(s) 501 may execute the software. Memory 503 may read the software from one or more other computer-readable media (such as mass storage device(s) 535, 536) or from one or more other sources through a suitable interface, such as network interface 520. The software may cause processor(s) 501 to carry out one or more processes or one or more steps of one or more processes described or illustrated herein. Carrying out such processes or steps may include defining data structures stored in memory 503 and modifying the data structures as directed by the software.

The memory 503 may include various components (e.g., machine readable media) including, but not limited to, a random access memory component (e.g., RAM 504) (e.g., static RAM (SRAM), dynamic RAM (DRAM), ferroelectric random access memory (FRAM), phase-change random access memory (PRAM), etc.), a read-only memory component (e.g., ROM 505), and any combinations thereof. ROM 505 may act to communicate data and instructions unidirectionally to processor(s) 501, and RAM 504 may act to communicate data and instructions bidirectionally with processor(s) 501. ROM 505 and RAM 504 may include any suitable tangible computer-readable media described below. In one example, a basic input/output system 506 (BIOS), including basic routines that help to transfer information between elements within computer system 500, such as during start-up, may be stored in the memory 503.

Fixed storage 508 is connected bidirectionally to processor(s) 501, optionally through storage control unit 507. Fixed storage 508 provides additional data storage capacity and may also include any suitable tangible computer-readable media described herein. Storage 508 may be used to store operating system 509, executable(s) 510, data 511, applications 512 (application programs), and the like. Storage 508 can also include an optical disk drive, a solid-state memory device (e.g., flash-based systems), or a combination of any of the above. Information in storage 508 may, in appropriate cases, be incorporated as virtual memory in memory 503.

In one example, storage device(s) 535 may be removably interfaced with computer system 500 (e.g., via an external port connector (not shown)) via a storage device interface 525. Particularly, storage device(s) 535 and an associated machine-readable medium may provide non-volatile and/or volatile storage of machine-readable instructions, data structures, program modules, and/or other data for the computer system 500. In one example, software may reside, completely or partially, within a machine-readable medium on storage device(s) 535. In another example, software may reside, completely or partially, within processor(s) 501.

Bus 540 connects a wide variety of subsystems. Herein, reference to a bus may encompass one or more digital signal lines serving a common function, where appropriate. Bus 540 may be any of several types of bus structures including, but not limited to, a memory bus, a memory controller, a peripheral bus, a local bus, and any combinations thereof, using any of a variety of bus architectures. As an example and not by way of limitation, such architectures include an Industry Standard Architecture (ISA) bus, an Enhanced ISA (EISA) bus, a Micro Channel Architecture (MCA) bus, a Video Electronics Standards Association local bus (VLB), a Peripheral Component Interconnect (PCI) bus, a PCI-Express (PCI-X) bus, an Accelerated Graphics Port (AGP) bus, HyperTransport (HTX) bus, serial advanced technology attachment (SATA) bus, and any combinations thereof.

Computer system 500 may also include an input device 533. In one example, a user of computer system 500 may enter commands and/or other information into computer system 500 via input device(s) 533. Examples of an input device(s) 533 include, but are not limited to, an alphanumeric input device (e.g., a keyboard), a pointing device (e.g., a mouse or touchpad), a touchpad, a touch screen, a multi-touch screen, a joystick, a stylus, an audio input device (e.g., a microphone, a voice response system, etc.), an optical scanner, a video or still image capture device (e.g., a camera), and any combinations thereof. In some embodiments, the input device is a Kinect, Leap Motion, or the like. Input device(s) 533 may be interfaced to bus 540 via any of a variety of input interfaces 523 (e.g., input interface 523) including, but not limited to, serial, parallel, USB, FIREWIRE, THUNDERBOLT, or any combination of the above.

In particular embodiments, when computer system 500 is connected to network 530, computer system 500 may communicate with other devices, specifically mobile devices and enterprise systems, distributed computing systems, cloud storage systems, cloud computing systems, and the like, connected to network 530. Communications to and from computer system 500 may be sent through network interface 520. For example, network interface 520 may receive incoming communications (such as requests or responses from other devices) in the form of one or more packets (such as Internet Protocol (IP) packets) from network 530, and computer system 500 may store the incoming communications in memory 503 for processing. Computer system 500 may similarly store outgoing communications (such as requests or responses to other devices) in the form of one or more packets in memory 503 and communicated to network 530 from network interface 520. Processor(s) 501 may access these communication packets stored in memory 503 for processing.

Examples of the network interface 520 include, but are not limited to, a network interface card, a modem, and any combination thereof. Examples of a network 530 or network segment 530 include, but are not limited to, a distributed computing system, a cloud computing system, a wide area network (WAN) (e.g., the Internet, an enterprise network), a local area network (LAN) (e.g., a network associated with an office, a building, a campus or other relatively small geographic space), a telephone network, a direct connection between two computing devices, a peer-to-peer network, and any combinations thereof. A network, such as network 530, may employ a wired and/or a wireless mode of communication. In general, any network topology may be used.

Information and data can be displayed through a display 532. Examples of a display 532 include, but are not limited to, a cathode ray tube (CRT), a liquid crystal display (LCD), a thin film transistor liquid crystal display (TFT-LCD), an organic liquid crystal display (OLED) such as a passive-matrix OLED (PMOLED) or active-matrix OLED (AMOLED) display, a plasma display, and any combinations thereof. The display 532 can interface to the processor(s) 501, memory 503, and fixed storage 508, as well as other devices, such as input device(s) 533, via the bus 540. The display 532 is linked to the bus 540 via a video interface 522, and transport of data between the display 532 and the bus 540 can be controlled via the graphics control 521. In some embodiments, the display is a video projector. In some embodiments, the display is a head-mounted display (HMD) such as a VR headset. In further embodiments, suitable VR headsets include, by way of non-limiting examples, HTC Vive, Oculus Rift, Samsung Gear VR, Microsoft HoloLens, Razer OSVR, FOVE VR, Zeiss VR One, Avegant Glyph, Freefly VR headset, and the like. In still further embodiments, the display is a combination of devices such as those disclosed herein.

In addition to a display 532, computer system 500 may include one or more other peripheral output devices 534 including, but not limited to, an audio speaker, a printer, a storage device, and any combinations thereof. Such peripheral output devices may be connected to the bus 540 via an output interface 524. Examples of an output interface 524 include, but are not limited to, a serial port, a parallel connection, a USB port, a FIREWIRE port, a THUNDERBOLT port, and any combinations thereof.

In addition or as an alternative, computer system 500 may provide functionality as a result of logic hardwired or otherwise embodied in a circuit, which may operate in place of or together with software to execute one or more processes or one or more steps of one or more processes described or illustrated herein. Reference to software in this disclosure may encompass logic, and reference to logic may encompass software. Moreover, reference to a computer-readable medium may encompass a circuit (such as an IC) storing software for execution, a circuit embodying logic for execution, or both, where appropriate. The present disclosure encompasses any suitable combination of hardware, software, or both.

Those of skill in the art will appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by one or more processor(s), or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In accordance with the description herein, suitable computing devices include, by way of non-limiting examples, server computers, desktop computers, laptop computers, notebook computers, sub-notebook computers, netbook computers, netpad computers, set-top computers, media streaming devices, handheld computers, Internet appliances, tablet computers, personal digital assistants, and vehicles.

Those of skill in the art will also recognize that select televisions, video players, and digital music players with optional computer network connectivity are suitable for use in the system described herein. Suitable tablet computers, in various embodiments, include those with booklet, slate, and convertible configurations, known to those of skill in the art.

In some embodiments, the computing device includes an operating system configured to perform executable instructions. The operating system is, for example, software, including programs and data, which manages the device's hardware and provides services for execution of applications. Those of skill in the art will recognize that suitable server operating systems include, by way of non-limiting examples, FreeBSD, OpenBSD, NetBSD®, Linux, Apple® Mac OS X Server®, Oracle® Solaris®, Windows Server®, and Novell® NetWare®. Those of skill in the art will recognize that suitable personal computer operating systems include, by way of non-limiting examples, Microsoft® Windows®, Apple® Mac OS X®, UNIX®, and UNIX-like operating systems such as GNU/Linux®. In some embodiments, the operating system is provided by cloud computing.

Non-Transitory Computer Readable Storage Medium

In some embodiments, the platforms, systems, media, and methods disclosed herein include one or more non-transitory computer readable storage media encoded with a program including instructions executable by the operating system of an optionally networked computing device. In further embodiments, a computer readable storage medium is a tangible component of a computing device. In still further embodiments, a computer readable storage medium is optionally removable from a computing device. In some embodiments, a computer readable storage medium includes, by way of non-limiting examples, CD-ROMs, DVDs, flash memory devices, solid-state memory, magnetic disk drives, magnetic tape drives, optical disk drives, distributed computing systems including cloud computing systems and services, and the like. In some cases, the program and instructions are permanently, substantially permanently, semi-permanently, or non-transitorily encoded on the media.

Computer Program

In some embodiments, the platforms, systems, media, and methods disclosed herein include at least one computer program, or use of the same. A computer program includes a sequence of instructions, executable by one or more processor(s) of the computing device's CPU, written to perform a specified task. Computer readable instructions may be implemented as program modules, such as functions, objects, Application Programming Interfaces (APIs), computing data structures, and the like, that perform particular tasks or implement particular abstract data types. In light of the disclosure provided herein, those of skill in the art will recognize that a computer program may be written in various versions of various languages.

The functionality of the computer readable instructions may be combined or distributed as desired in various environments. In some embodiments, a computer program comprises one sequence of instructions. In some embodiments, a computer program comprises a plurality of sequences of instructions. In some embodiments, a computer program is provided from one location. In other embodiments, a computer program is provided from a plurality of locations. In various embodiments, a computer program includes one or more software modules. In various embodiments, a computer program includes, in part or in whole, one or more web applications, one or more mobile applications, one or more standalone applications, extensions, add-ins, or add-ons, or combinations thereof.

Web Application

In some embodiments, a computer program includes a web application. In light of the disclosure provided herein, those of skill in the art will recognize that a web application, in various embodiments, utilizes one or more software frameworks and one or more database systems. In some embodiments, a web application is created upon a software framework such as Microsoft® .NET or Ruby on Rails (RoR). In some embodiments, a web application utilizes one or more database systems including, by way of non-limiting examples, relational, non-relational, object oriented, associative, XML, and document oriented database systems. In further embodiments, suitable relational database systems include, by way of non-limiting examples, Microsoft® SQL Server, mySQL™, and Oracle®. Those of skill in the art will also recognize that a web application, in various embodiments, is written in one or more versions of one or more languages. A web application may be written in one or more markup languages, presentation definition languages, client-side scripting languages, server-side coding languages, database query languages, or combinations thereof. In some embodiments, a web application is written to some extent in a markup language such as Hypertext Markup Language (HTML), Extensible Hypertext Markup Language (XHTML), or eXtensible Markup Language (XML). In some embodiments, a web application is written to some extent in a presentation definition language such as Cascading Style Sheets (CSS). In some embodiments, a web application is written to some extent in a client-side scripting language such as Asynchronous JavaScript and XML (AJAX), Flash® ActionScript, JavaScript, or Silverlight®. In some embodiments, a web application is written to some extent in a server-side coding language such as Active Server Pages (ASP), ColdFusion®, Perl, Java™, JavaServer Pages (JSP), Hypertext Preprocessor (PHP), Python™, Ruby, Tcl, Smalltalk, WebDNA®, or Groovy. In some embodiments, a web application is written to some extent in a database query language such as Structured Query Language (SQL). In some embodiments, a web application integrates enterprise server products such as IBM® Lotus Domino®. In some embodiments, a web application includes a media player element. In various further embodiments, a media player element utilizes one or more of many suitable multimedia technologies including, by way of non-limiting examples, Adobe® Flash®, HTML 5, Apple® QuickTime®, Microsoft® Silverlight®, Java™, and Unity®.

Figure 6:
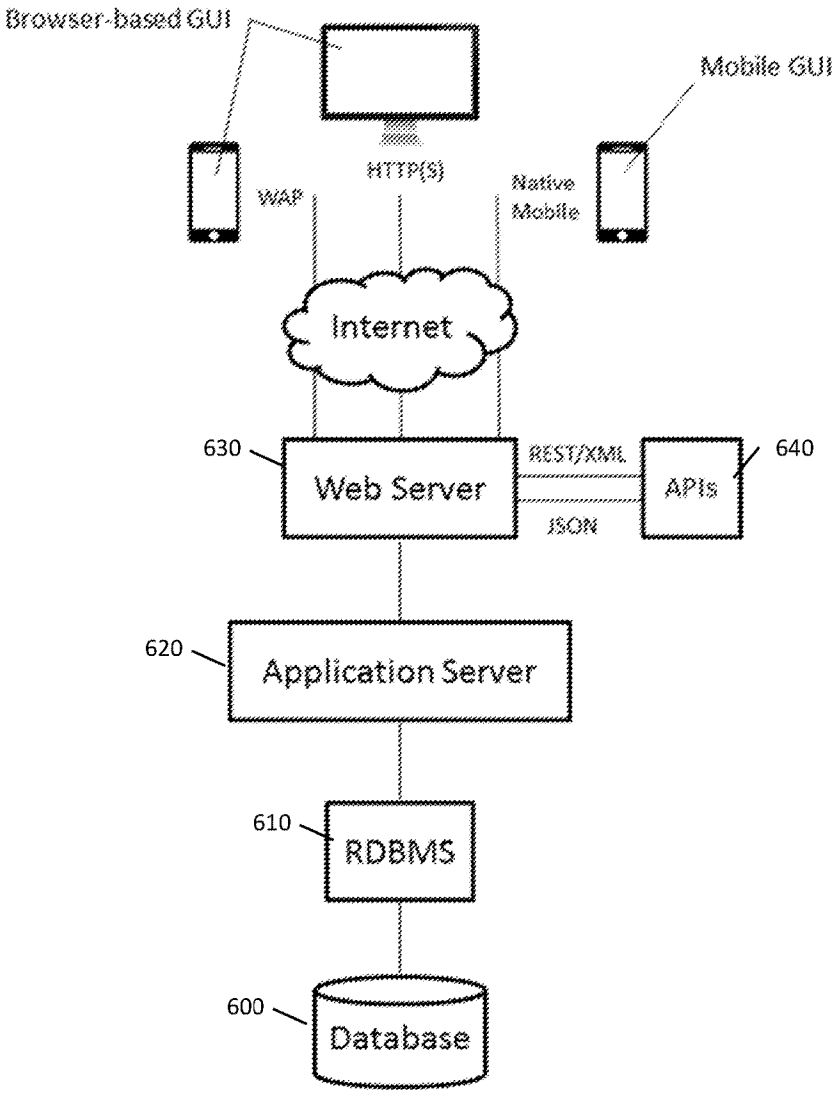
FIG. 6 shows a non-limiting example of a web/mobile application provision system; in this case, a system providing browser-based and/or native mobile user interfaces, in accordance with some embodiments.

Referring to FIG. 6, in a particular embodiment, an application provision system comprises one or more databases 600 accessed by a relational database management system (RDBMS) 610. Suitable RDBMSs include Firebird, MySQL, PostgreSQL, SQLite, Oracle Database, Microsoft SQL Server, IBM DB2, IBM Informix, SAP Sybase, Teradata, and the like. In this embodiment, the application provision system further comprises one or more application severs 620 (such as Java servers, .NET servers, PHP servers, and the like) and one or more web servers 630 (such as Apache, IIS, GWS and the like). The web server(s) optionally expose one or more web services via app application programming interfaces (APIs) 640. Via a network, such as the Internet, the system provides browser-based and/or mobile native user interfaces.

Figure 7:
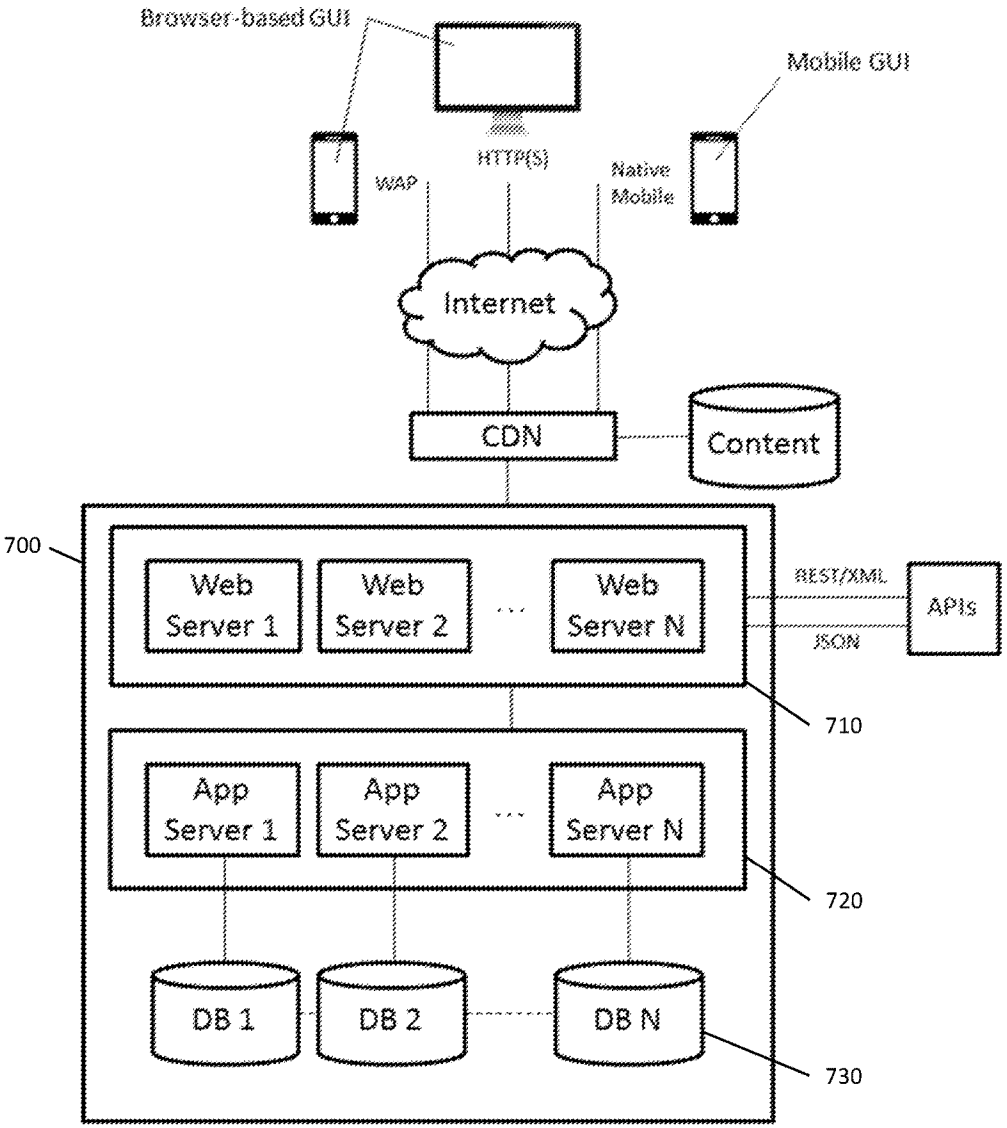
FIG. 7 shows a non-limiting example of a cloud-based web/mobile application provision system; in this case, a system comprising an elastically load balanced, auto-scaling web server and application server resources as well synchronously replicated databases, in accordance with some embodiments.

Referring to FIG. 7, in a particular embodiment, an application provision system alternatively has a distributed, cloud-based architecture 700 and comprises elastically load balanced, auto-scaling web server resources 710 and application server resources 720 as well synchronously replicated databases 730.

Mobile Application

In some embodiments, a computer program includes a mobile application provided to a mobile computing device. In some embodiments, the mobile application is provided to a mobile computing device at the time it is manufactured. In other embodiments, the mobile application is provided to a mobile computing device via the computer network described herein.

In view of the disclosure provided herein, a mobile application is created by techniques known to those of skill in the art using hardware, languages, and development environments known to the art. Those of skill in the art will recognize that mobile applications are written in several languages. Suitable programming languages include, by way of non-limiting examples, C, C++, C #, Objective-C, Java™, JavaScript, Pascal, Object Pascal, Python™, Ruby, VB.NET, WML, and XHTML/HTML with or without CSS, or combinations thereof.

Suitable mobile application development environments are available from several sources. Commercially available development environments include, by way of non-limiting examples, AirplaySDK, alcheMo, Appcelerator®, Celsius, Bedrock, Flash Lite, NET Compact Framework, Rhomobile, and WorkLight Mobile Platform. Other development environments are available without cost including, by way of non-limiting examples, Lazarus, MobiFlex, MoSync, and PhoneGap. Also, mobile device manufacturers distribute software developer kits including, by way of non-limiting examples, iPhone and iPad (iOS) SDK, Android™ SDK, BlackBerry® SDK, BREW SDK, Palm® OS SDK, Symbian SDK, webOS SDK, and Windows® Mobile SDK.

Standalone Application

In some embodiments, a computer program includes a standalone application, which is a program that is run as an independent computer process, not an add-on to an existing process, e.g., not a plug-in. Those of skill in the art will recognize that standalone applications are often compiled. A compiler is a computer program(s) that transforms source code written in a programming language into binary object code such as assembly language or machine code. Suitable compiled programming languages include, by way of non-limiting examples, C, C++, Objective-C, COBOL, Delphi, Eiffel, Java™, Lisp, Python™, Visual Basic, and VB NET, or combinations thereof. Compilation is often performed, at least in part, to create an executable program. In some embodiments, a computer program includes one or more executable complied applications.

Software Modules

In some embodiments, the platforms, systems, media, and methods disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, a distributed computing resource, a cloud computing resource, or combinations thereof. In further various embodiments, a software module comprises a plurality of files, a plurality of sections of code, a plurality of programming objects, a plurality of programming structures, a plurality of distributed computing resources, a plurality of cloud computing resources, or combinations thereof. In various embodiments, the one or more software modules comprise, by way of non-limiting examples, a web application, a mobile application, a standalone application, and a distributed or cloud computing application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on a distributed computing platform such as a cloud computing platform. In some embodiments, software modules are hosted on one or more machines in one location. In other embodiments, software modules are hosted on one or more machines in more than one location.

Databases

In some embodiments, the platforms, systems, media, and methods disclosed herein include one or more databases, or use of the same. In view of the disclosure provided herein, those of skill in the art will recognize that many databases are suitable for storage and retrieval of, for example, EMV movement data, target depth data, blade boom angle data, machine pitch data, inclinometer output data, net pitch angle data, vector data, and other information and/or data discussed in this disclosure. In various embodiments, suitable databases include, by way of non-limiting examples, relational databases, non-relational databases, object oriented databases, object databases, entity-relationship model databases, associative databases, XML databases, document oriented databases, and graph databases. Further non-limiting examples include SQL, PostgreSQL, MySQL, Oracle, DB2, Sybase, and MongoDB. In some embodiments, a database is Internet-based. In further embodiments, a database is web-based. In still further embodiments, a database is cloud computing-based. In a particular embodiment, a database is a distributed database. In other embodiments, a database is based on one or more local computer storage devices.

Definitions

As used in this specification and the appended claims, the terms "artificial intelligence," "artificial intelligence techniques," "artificial intelligence operation," and "artificial intelligence algorithm" generally refer to any system or computational procedure that may take one or more actions to enhance or maximize a chance of achieving a goal. The term "artificial intelligence" may include "generative modeling," "machine learning" (ML), or "reinforcement learning" (RL).

As used in this specification and the appended claims, the terms "machine learning," "machine learning techniques," "machine learning operation," and "machine learning model" generally refer to any system or analytical or statistical procedure that may progressively improve computer performance of a task.

As used in this specification and the appended claims, "some embodiments," "further embodiments," or "a particular embodiment," means that a particular feature, structure, or characteristic described in connection with the embodiment is included in at least one embodiment. Thus, the appearances of the phrase "in some embodiments," or "in further embodiments," or "in a particular embodiment" in various places throughout this specification are not necessarily all referring to the same embodiment. Furthermore, the particular features, structures, or characteristics may be combined in any suitable manner in one or more embodiments.

Whenever the term "at least," "greater than," or "greater than or equal to" precedes the first numerical value in a series of two or more numerical values, the term "at least," "greater than" or "greater than or equal to" applies to each of the numerical values in that series of numerical values. For example, greater than or equal to 1, 2, or 3 is equivalent to greater than or equal to 1, greater than or equal to 2, or greater than or equal to 3.

Whenever the term "no more than," "less than," or "less than or equal to" precedes the first numerical value in a series of two or more numerical values, the term "no more than," "less than," or "less than or equal to" applies to each of the numerical values in that series of numerical values. For example, less than or equal to 3, 2, or 1 is equivalent to less than or equal to 3, less than or equal to 2, or less than or equal to 1.

The term "real time" or "real-time," as used interchangeably herein, generally refers to an event (e.g., an operation, a process, a method, a technique, a computation, a calculation, an analysis, a visualization, an optimization, etc.) that is performed using recently obtained (e.g., collected or received) data. In some cases, a real time event may be performed almost immediately or within a short enough time span, such as within at least 0.0001 millisecond (ms), 0.0005 ms, 0.001 ms, 0.005 ms, 0.01 ms, 0.05 ms, 0.1 ms, 0.5 ms, 1 ms, 5 ms, 0.01 seconds, 0.05 seconds, 0.1 seconds, 0.5 seconds, 1 second, or more. In some cases, a real time event may be performed almost immediately or within a short enough time span, such as within at most 1 second, 0.5 seconds, 0.1 seconds, 0.05 seconds, 0.01 seconds, 5 ms, 1 ms, 0.5 ms, 0.1 ms, 0.05 ms, 0.01 ms, 0.005 ms, 0.001 ms, 0.0005 ms, 0.0001 ms, or less.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A method of autonomously operating an earth moving vehicle (EMV) comprising (i) a boom connected to the EMV at a boom joint and (ii) a blade connected to an end of the boom, the method comprising:

(a) determining a trajectory of operation of the EMV;

(b) applying an artificial intelligence model to dynamically determine a target depth of the blade for one or more points on the trajectory of operation by performing at least:

(i) determining a base vector relating to a distance in an x-direction, a y-direction, and a z-direction between the boom joint and a bottom corner of the blade when an angle between the boom joint and the bottom corner of the blade is a reference angle, (ii) rotating the base vector using a rotation matrix to dynamically generate a current vector, wherein the current vector relates to the distance in an x-direction, a y-direction, and a z-direction between the boom joint and the bottom corner of the blade when the angle between the boom joint and the bottom corner of the blade is more than the reference angle or less than the reference angle at a current timepoint;

(iii) determining a blade position vector at the current timepoint based at least in part on the current vector, and (iv) determining a current depth of the blade at the current timepoint based at least in part on the blade position vector; and (c) autonomously adjusting the current depth of the blade based at least in part on the target depth of the blade at the one or more points on the trajectory of operation.

2. The method of claim 1, wherein dynamically determining the target depth of the blade comprises dynamically determining a lowest point of the blade.

3. The method of claim 2, wherein dynamically determining the lowest point of the blade further comprises determining the base vector.

4. The method of claim 3, wherein the base vector comprises the distance in the x-direction, the y-direction, and the z-direction from an (x, y, z) coordinate location of the boom joint to an (x, y, z) coordinate location of the bottom corner of the blade when a blade boom angle and a machine pitch are both at the reference angle.

5. The method of claim 3, further comprising retrieving the base vector from a memory.

6. The method of claim 1, wherein dynamically generating the current vector further comprises multiplying the base vector by the rotation matrix to rotate the base vector, thereby determining a distance in the x-direction, the y-direction, and the z-direction from an (x, y, z) coordinate location of the boom joint at the current timepoint to an (x, y, z) coordinate location of the lowest point of the blade at the current timepoint.

7. The method of claim 6, further comprising multiplying the base vector by the rotation matrix using matrix multiplication.

8. The method of claim 1, wherein the rotation matrix comprises:

$$\begin{bmatrix} \cos\theta & 0 & \sin\theta \\ 0 & 1 & 0 \\ -\sin\theta & 0 & \cos\theta \end{bmatrix},$$

wherein θ comprises a net pitch angle.

9. The method of claim 8, further comprising dynamically determining the net pitch angle.

10. The method of claim 9, wherein the net pitch angle is dynamically determined based at least in part on a blade boom angle and a machine pitch.

11. The method of claim 10, wherein the net pitch angle is dynamically determined by addition of the blade boom angle and a value relating to the machine pitch.

12. The method of claim 10, further comprising dynamically determining (i) the blade boom angle or (ii) the machine pitch, or both (i) and (ii), from sensor data received from one or more sensors of the EMV.

13. The method of claim 12, wherein the one or more sensors comprise inclinometers.

14. The method of claim 10, further comprising dynamically determining the machine pitch based at least in part on an angle between a bottom plane of the EMV relative to a direction of gravity.

15. The method of claim 10, further comprising dynamically determining the blade boom angle based at least in part on an angle formed by the boom relative to a line parallel to a bottom plane of the EMV.

16. The method of claim 15, further comprising dynamically determining a center point of the EMV using the one or more sensors of the EMV.

17. The method of claim 16, further comprising dynamically determining the center point of the EMV based at least in part on one or more of: a latitude, a longitude, an altitude, or real-time GPS positioning data of the EMV, or any combination thereof, received from the one or more sensors of the EMV.

18. The method of claim 1, further comprising dynamically generating the blade position vector by adding the current vector and a boom joint vector, wherein the boom joint vector relates to a distance in an x-direction, a y-direction, and a z-direction between an (x, y, z) coordinate location of the boom joint and an (x, y, z) coordinate location of a machine center of the EMV.

19. The method of claim 18, further comprising dynamically generating the boom joint vector based at least in part on a difference between the (x, y, z) coordinate location of the boom joint at the current time point and the (x, y, z) coordinate location of the machine center of the EMV at the current time point.

20. The method of claim 19, further comprising dynamically determining the center point of the EMV comprising the (x, y, z) coordinate location of the machine center of the EMV at the current time point, or the position of the boom joint comprising the (x, y, z) coordinate location of the boom joint at the current time point, or both.

21. The method of claim 1, wherein the current depth of the blade comprises a z-coordinate of the blade position vector.

22. The method of claim 1, wherein dynamically adjusting the current depth of the blade further comprises comparing the current depth of the blade and the target depth of the blade.

23. The method of claim 22, wherein dynamically adjusting the current depth of the blade further comprises modifying a blade boom angle where the current depth of the blade is higher or lower than the target depth of the blade.

24. The method of claim 23, wherein the blade boom angle comprises an angle of the boom relative to a line parallel to a bottom plane of the EMV.

25. The method of claim 24, wherein dynamically adjusting the current depth of the blade further comprises increasing the blade boom angle where the current depth of the blade is lower than the target depth of the blade.

26. The method of claim 22, wherein dynamically adjusting the current depth of the blade further comprises decreasing the blade boom angle where the current depth of the blade is higher than the target depth of the blade.

27. The method of claim 1, wherein dynamically adjusting the current depth of the blade further comprises adjusting the current depth based at least in part on one or more detected qualities of one or more materials.

28. The method of claim 1, further comprising autonomously moving the EMV according to the trajectory of operation while autonomously adjusting the current depth of the blade.

29. The method of claim 1, wherein the reference angle is 0 degrees.

* * * * *